US011428391B1

(12) United States Patent
Zou

(10) Patent No.: US 11,428,391 B1
(45) Date of Patent: Aug. 30, 2022

(54) WIRE ARRANGING DEVICE, BULB LAMP, AND LIGHT STRING

(71) Applicant: DONGGUAN TUOYING PHOTOELECTRIC TECHNOLOGY CO., LTD., Dongguan (CN)

(72) Inventor: Huisheng Zou, Dongguan (CN)

(73) Assignee: DONGGUAN TUOYING PHOTOELECTRIC TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/245,014

(22) Filed: Apr. 30, 2021

(30) Foreign Application Priority Data

Apr. 12, 2021 (CN) ..... 202120740901.X

(51) Int. Cl.

| | |
|---|---|
| ***F21V 23/00*** | (2015.01) |
| ***F21K 9/232*** | (2016.01) |
| ***F21S 4/10*** | (2016.01) |
| ***F21Y 115/10*** | (2016.01) |

(52) U.S. Cl.
CPC ..... *F21V 23/002* (2013.01); *F21K 9/232* (2016.08); *F21S 4/10* (2016.01); *F21Y 2115/10* (2016.08)

(58) Field of Classification Search
CPC ..... F21W 23/002; F21S 4/10
See application file for complete search history.

(56) References Cited

U.S. PATENT DOCUMENTS

| | | | | |
|---|---|---|---|---|
| 5,526,250 | A * | 6/1996 | Ting | H01R 25/142 362/391 |
| 8,070,347 | B1 * | 12/2011 | Lin | F21V 31/00 362/654 |
| 8,876,547 | B1 * | 11/2014 | Tsai | H01R 13/504 439/906 |
| 9,777,912 | B2 * | 10/2017 | Tsai | F21V 19/0025 |
| 10,100,986 | B2 * | 10/2018 | Lin | F21S 4/10 |
| 2012/0302097 | A1 * | 11/2012 | Yang | H01R 33/02 439/620.02 |

* cited by examiner

*Primary Examiner* — Matthew J. Peerce

(57) ABSTRACT

A wire arranging device configured to arrange a lead-in wire and a lead-out wire includes a lead-in path configured to arrange the lead-in wire and a lead-out path configured to arrange the lead-out wire. A bulb lamp and a light string including the wire arranging device are provided.

12 Claims, 12 Drawing Sheets

WIRE ARRANGING DEVICE, BULB LAMP, AND LIGHT STRING

CROSS REFERENCE TO RELATED APPLICATIONS

This application claims priority to Chinese Patent Application No. 202120740901.X, filed opening on Apr. 12, 2021, the content of which is herein incorporated by reference in its entity.

TECHNICAL FIELD

The present disclosure relates to the technical field of lighting devices, and in particular, to a wire arranging device, a bulb lamp, and a light string.

BACKGROUND

With rapid development of LED (Light Emitting Diode) technology, the LED has advantages of having a small size, a low power consumption, a long service life, and a high brightness, and being environmental protective, or the like, and thus LED has been widely used in the lighting industry, in particular used in a decorative light string for a lighting decoration. In the related art, a bulb lamp is formed by a wick connected to wires and a lampshade covering an outer side of the wick. The wick is formed by curing a plurality of electroluminescent semiconductor chips with silver glue or white latex.

In a practical application, a plurality of bulb lamps are generally connected in series to form a light string. Therefore, the wick of each bulb lamp includes a lead-in wire and a lead-out wire to connect to other bulb lamps. However, in an existing bulb lamp, both the lead-in wire and the lead-out wire need to be electrically connected to a plug to supply power to the bulb lamp, the connection structure is complicated and is unable to detach. In addition, the wick and the wires of the bulb lamp are not easily assembled to or disassembled from other components of the bulb lamp. Thus, it will cause a lot of troubles in use, for example, it is not easy to repair or replace the components of the bulb lamps in the light string (such as the wick, the wires, a lamp holder, a lampshade, or the like).

SUMMARY

The present disclosure is to provide a wire arranging device, a bulb lamp, and alight string.

The present disclosure is realized through the technical solutions in the following aspects.

First Aspect of the Present Disclosure

In the first aspect, a wire arranging device is disclosed. The wire arranging device is configured to arrange a lead-in wire and a lead-out wire. The wire arranging device includes a lead-in path, configured to arrange the lead-in wire; and a lead-out path, configured to arrange the lead-out wire.

By using the lead-in path and the lead-out path, the lead-in wire and the lead-out wire may be detachably arranged in the bulb lamp by the wire arranging device. The space occupied by the lead-in wire and the lead-out wire may be reduced, which makes the overall structure of the bulb lamp more compact, and also enables the wires to be arranged in the bulb lamp in a more neat and beautiful way.

Furthermore, the wire arranging device is configured as an independent component in the bulb lamp. In this way, it is possible to realize the detachable connection between the wick, the wires, and other components in the bulb lamp (for example, a lamp holder, a lampshade, or the like).

In some embodiments, the wire arranging device includes a wick positioning portion; a holder connecting portion; a path extending portion, connected between the wick positioning portion and the holder connecting portion; a lead-in restricting structure, configured to restrict the lead-in path; and a lead-out restricting structure, configured to restrict the lead-out path. Each of the lead-out restricting structure and the lead-out restricting structure is arranged on the wick positioning portion, the holder connecting portion, and the path extending portion.

It should be noted that, the wick positioning portion may be connected to the wick, the wick positioning portion may be configured to fix a position of the wick and reduce the possibility of shaking of the wick. The holder connecting portion may be connected to the lamp holder 40. A length of the path extending portion may be set as required. In some embodiments of the present disclosure, lengths of the lead-in path and the lead-out path and a distance between the wick and the path extending portion may be both adjusted based on the length of the path extending portion.

The lead-in restricting structure and the lead-out restricting structure may be implemented as grooves having the limiting or restricting function. However, in some other embodiments, the lead-in restricting structure and the lead-out restricting structure may also be implemented as other structures, such as restricting holes.

In some embodiments, the lead-in restricting structure comprises: a first lead-in groove, defined in the wick positioning portion; a second lead-in groove, defined in the holder connecting portion; and a third lead-in groove, defined in the path extending portion. The second lead-in groove, the third lead-in groove, and the first lead-in groove are subsequently arranged, and the lead-in path is defined by the second lead-in groove, the third lead-in groove, and the first lead-in groove. The lead-out restricting structure comprises: a first lead-out groove, defined in the wick positioning portion; a second lead-out groove, defined in the holder connecting portion; and a third lead-out groove, defined in the path extending portion. The first lead-out groove, the third lead-out groove, and the second lead-out groove are subsequently arranged, and the lead-out path is defined by the first lead-out groove, the third lead-out groove, and the second lead-out groove.

It should be noted that, when installing the lead-in wire and the lead-out wire, the lead-in wire may be subsequently placed in and pass through the corresponding second lead-in groove, the third lead-in groove, and the first lead-in groove along the lead-in path. The lead-out wire may be subsequently placed in and pass through the corresponding the first lead-out groove, the third lead-out groove, and the second lead-out groove along the lead-out path.

In some embodiments, a width of the path extending portion may be less than a width of the wick positioning portion, and further less than a width of the holder connecting portion.

The path extending portion may be located in a middle of the wick positioning portion and a middle of the holder connecting portion along a width direction. In this way, the wire arranging device may be substantially in shape of an "I". It should be noted that, the width direction here refers to the left-tight direction.

In some embodiments, the wick positioning portion defines a receiving groove on a side away from the path extending portion, and the receiving groove is configured to receive a wick of the bulb lamp. In other words, the receiving groove may be defined at a bottom of the wick positioning portion. In this way, the wick may be received in the receiving groove, such that the wick may be better fixed or limited in the wick positioning portion.

In some embodiments, the receiving groove may be configured to receive or accommodate a part of a wick body of the wick. That is to say, only a part of the wick body of the wick may be received in the receiving groove. In this way, it is possible to reduce the possibility of excessive shielding of the light emitted from the wick by the receiving groove.

In some embodiments, the wick positioning portion comprises two opposite side walls in the receiving groove, and the first lead-in groove and the first lead-out groove are arranged on the two opposite side walls in the receiving groove.

In some embodiments, an opening of the first lead-in groove and an opening of the first lead-out groove faces towards a same direction as an opening of the receiving groove, that is, facing towards the bottom.

In some embodiments, a lead-in restricting portion is arranged in the wick positioning portion at a position adjacent to an opening of the third lead-in groove; and a lead-out restricting portion is arranged in the wick positioning portion at a position adjacent to an opening of the third lead-out groove. The lead-in restricting portion and the lead-out restricting portion may be configured to better limit or restrict the lead-in wire in the lead-in path and limit or restrict the lead-out wire in the lead-out path.

In some embodiments, a wiring direction of the first lead-in groove is located in a plane different from a plane in which a wiring direction of the third lead-in groove is located; and a wiring direction of the first lead-out groove is located in a plane different from a plane in which a wiring direction of the third lead-out groove is located. It should be noted that, the wiring directions in the first lead-in groove, the first lead-out groove, the third lead-in groove, and the third lead-out groove are substantially coincident with the corresponding lead-in path or lead-out path, and "coincident with" here may include "the same as".

A wire inlet is defined between the third lead-in groove and the wick positioning portion along the wiring direction of the third lead-in groove.

A wire outlet is defined between the third lead-out groove and the wick positioning portion along the wiring direction of the third lead-out groove.

The wire inlet is configured to enable the lead-in wire to extend out of the third lead-in groove and further enter the first lead-in groove.

The wire outlet is configured to enable the lead-out wire to extend out of the first lead-out groove and further enter the third lead-out groove.

In some embodiments, the third lead-in groove and the third lead-out groove are arranged side by side.

The path extending portion comprises a partition wall separating the third lead-in groove from the third lead-out groove, and the partition wall defines a first opening. The design of the first opening may facilitate an operation of a finger of an operator to place the wire into the corresponding third lead-in groove and the third lead-out groove.

In some embodiments, the path extending portion comprises a first restricting wall, a second restricting wall, and partition wall disposed between the first restricting wall and the second restricting wall, and each of the first restricting wall and the second restricting wall defines a second opening. The design of the second opening may facilitate the operation of the finger of the operator to place the wire into the corresponding third lead-in groove and the third lead-out groove.

In some embodiments, the third lead-in groove is fluidly coupled to the second lead-in groove, and the third lead-out groove is fluidly coupled to the second lead-out groove. Thus, it is possible facilitate the wiring.

In some embodiments, the lead-in restricting structure further comprises a fourth lead-in groove defined in the holder connecting portion. The lead-out limiting structure further comprises a fourth lead-out groove defined in the holder connecting portion.

An opening of the fourth lead-in groove faces towards a direction opposite to a direction which an opening of the receiving groove faces towards. An opening of the fourth lead-out groove faces towards a direction opposite to a direction which the opening of the receiving groove faces towards.

The lead-in path may be formed or defined by the fourth lead-in groove, the second lead-in groove, the third lead-in groove, and the first lead-in groove. The lead-out path may be formed or defined by the first lead-out groove, the third lead-out groove, the second lead-out groove, and the fourth lead-out groove.

Since the opening of the receiving groove faces the bottom of the holder connecting portion, the opening of the fourth lead-in groove and the opening of the fourth lead-out groove may face a top of the holder connecting portion. In this way, the lead-in wire may enter from the top of the holder connecting portion through the fourth lead-in groove, and the lead-out wire may be led out or discharged from the top of the holder connecting portion through the fourth lead-out groove. Generally speaking, the lamp holder and the wick are respectively arranged at opposite sides of the wire arranging device, and the lead-in wire and the lead-out wire need to pass through the lamp holder at least partially covering the top of the holder connecting portion. Thus, the above design may facilitate the arrangement of the lead-in wire and the lead-out wire.

In some embodiments, the fourth lead-in groove may be fluidly coupled to the second lead-in groove. The fourth lead-out groove may be fluidly coupled to the second lead-out groove.

In some embodiments, the lead-in path is symmetrical to the lead-out path, which facilitates the design of the lead-in path and the lead-out path.

Second Aspect of the Present Disclosure

In the second aspect, a bulb lamp may be disclosed. The bulb lamp may include a lamp holder and the wire arranging device as described in the first aspect. The lamp holder defines a receiving space, and the wire arranging device is at least partially received in the receiving space and detachably connected to the lamp holder.

In some embodiments of the present disclosure, the wire arranging device may be detachably connected to the lamp holder via a screw connection or an engaging connection. The detachable connection mode may be determined by those skilled in the art according to actual needs of installation, and may be not limited to the above-mentioned exemplary screw connection or engaging connection.

In some embodiments, the lamp holder defines: a wire inlet hole, corresponding to the lead-in path; and a wire outlet hole, corresponding to the lead-out path.

In some embodiments, the wire inlet hole and the wire outlet hole may be arranged symmetrically, which facilitates the leading in and out of the wires.

In some embodiments, the lamp holder comprises: a holder body, being hollow and having an opening defined at an end of the holder body away from the wire arranging device and an opening defined at an end of the holder body adjacent to the wire arranging device; and a connecting member, detachably connected to the holder body at the opening defined at the end of the holder body away from the wire arranging device. A first hook and a second hook are arranged on the connecting member.

It should be noted that, the first hook may be arranged above the connecting member. The second hook may be arranged at any position on an outer side of the connecting member.

In some embodiments, an outlet recess and an inlet recess are defined on a side wall at the end of the holder body away from the wire arranging device. When the connecting member is connected to the holder body, an opening end of the outlet recess is covered by the connecting member to define the wire outlet hole, and an opening end of the inlet recess is covered by the connecting member to define the wire inlet hole.

In some embodiments, an engaging groove is defined on an inner side wall of the holder body, and an engaging portion corresponding to the engaging groove is arranged on the holder connecting portion. The holder body is detachably connected to the holder connecting portion via the engaging groove and the engaging portion, such that the wire arranging device is detachably connected to the lamp holder.

In some embodiments, the bulb lamp further includes a lampshade detachably connected to the lamp holder. When the lamp holder is connected to the lampshade, the wick extends into the lampshade.

Third Aspect of the Present Disclosure

In the third aspect, a light string may be disclosed. The light string may include a plurality of wire arranging devices as described in the first aspect; or a plurality of bulb lamps as described in the second aspect.

In some embodiments of the present disclosure, by using the lead-in path and the lead-out path, the lead-in wire and the lead-out wire may be arranged in a reasonable and orderly manner in the wire arranging device, such that the lead-in wire and the lead-out wire may be detachably arranged in the bulb lamp, and convenient to be stored. In this way, the space occupied by the lead-in wire and the lead-out wire may be reduced, which makes the overall structure of the bulb lamp more compact, and also enables the wires to be arranged in the bulb lamp in a more neat and beautiful way.

Furthermore, the wire arranging device is configured as an independent component in the bulb lamp. In this way, it is possible to realize the detachable connection between the wick, the wires, and other components in the bulb lamp (for example, a lamp holder 40, a lampshade, or the like), which facilitates the maintenance and repairing.

In some embodiments of the present disclosure, a bulb lamp is further provided. The bulb lamp includes the wire arrangement device, and can better receive the wires. Herein, a plurality of components of the bulb lamp (the lamp holder, the wick, the lampshade, the wire arrangement device, the lead-in wire, and the lead-out wire) are detachably connected to each other, which facilitates the disassembly and assembly.

In some embodiments of the present disclosure, a light string is further provided. The light string includes the bulb lamp or the wire arrangement device, which can have functions similar to those of the bulb lamp or the wire arrangement device.

BRIEF DESCRIPTION OF THE DRAWINGS

In order to describe the technical solutions in some embodiments of the present disclosure more clearly, the following briefly introduces the accompanying drawings required for describing the embodiments. Apparently, the accompanying drawings in the following description are merely some embodiments of the present disclosure. For those skilled in the art, other drawings may be obtained based on these drawings without creative efforts.

In the figures.

1, bulb lamp; 10, wick; 20, wire; 210, lead-in wire; 220, lead-out wire; 30, wire arranging device; 301, lead-in path; 302, lead-out path; 310, wick positioning portion; 311, first lead-in groove; 312, a first lead-out groove; 313, receiving groove; 314, lead-in restricting portion; 315, lead-out restricting portion; 320, holder connecting portion; 321, second lead-in groove; 322, second lead-out groove; 323, fourth lead-in groove; 324, fourth lead-out groove; 325, engaging portion; 330, path extending portion; 331, third lead-in groove; 332, third lead-out groove; 333, wire inlet; 334, wire outlet; 3312, partition wall; 335, first opening; 336, second opening; 40, lamp holder; 401, wire inlet hole; 402, wire outlet hole; 410, holder body; 411, outlet recess; 412, inlet recess; 413, engaging groove; 420, connecting member; 421, first hook; 422, second hook; 50, lampshade; 2, light string.

DETAILED DESCRIPTION

The technical solutions in the embodiments of the present disclosure will be clearly and completely described in detail below with reference to the accompanying drawings in the embodiments of the present disclosure. Apparently, the accompanying drawings in the following description are merely some embodiments of the present disclosure, not all the embodiments. For those skilled in the art, other embodiments can be obtained based on these embodiments of the present disclosure without creative efforts. All these fall into the protection scope of the present disclosure.

Terms "first", "second", "third", or the like, in the specification and claims of some embodiments of the present disclosure are configured to distinguish different objects, rather than to describe a specific order of the objects. For example, a first lead-in groove, a second lead-in groove, and a third lead-in groove are configured to distinguish different lead-in grooves, rather than to describe the specific order of the lead-in grooves. A first lead-out groove, a second lead-out groove, and a third lead-out groove are configured to distinguish different lead-out groove, rather than to describe the specific order of the lead-out grooves.

In some embodiments of the present disclosure, terms such as "exemplary", "for example", or the like, are configured to describe an example, an instance, or an illustration. Any embodiment or design solution described as "exemplary" or "for example" in some embodiments of the present disclosure should not be construed as being more preferable or advantageous than other embodiments or design solutions. More precisely, terms such as "exemplary", "for example", or the like, are configured to present related concepts in a specific manner.

Wire Arranging Device

Figure 1:
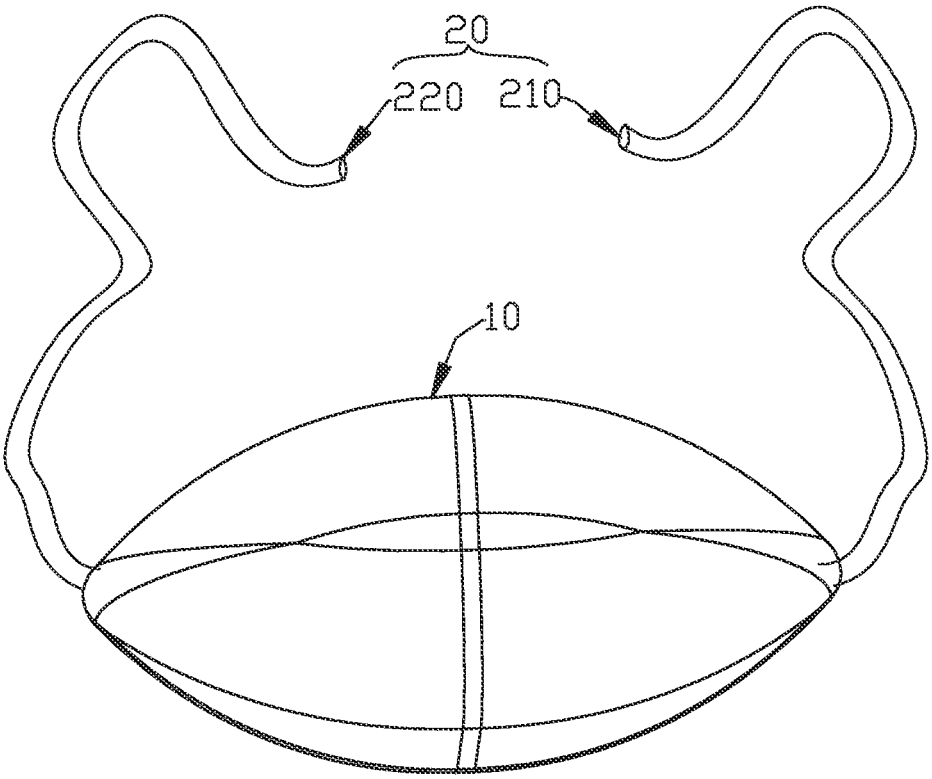
FIG. 1 is a schematic view of a wick, a lead-in wire, and a lead-out wire according to some embodiments of the present disclosure.
Figure 2:
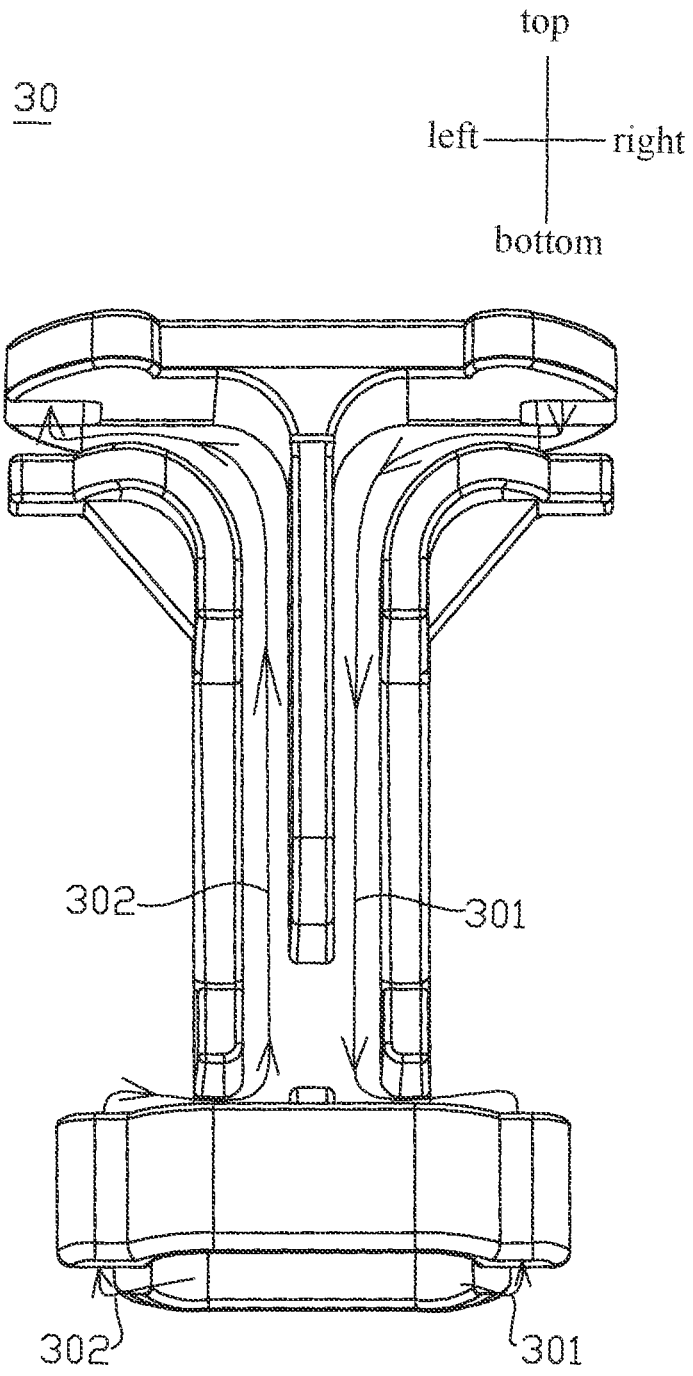
FIG. 2 is a schematic view of a wire arranging device of a bulb lamp according to some embodiments of the present disclosure.
Figure 8:
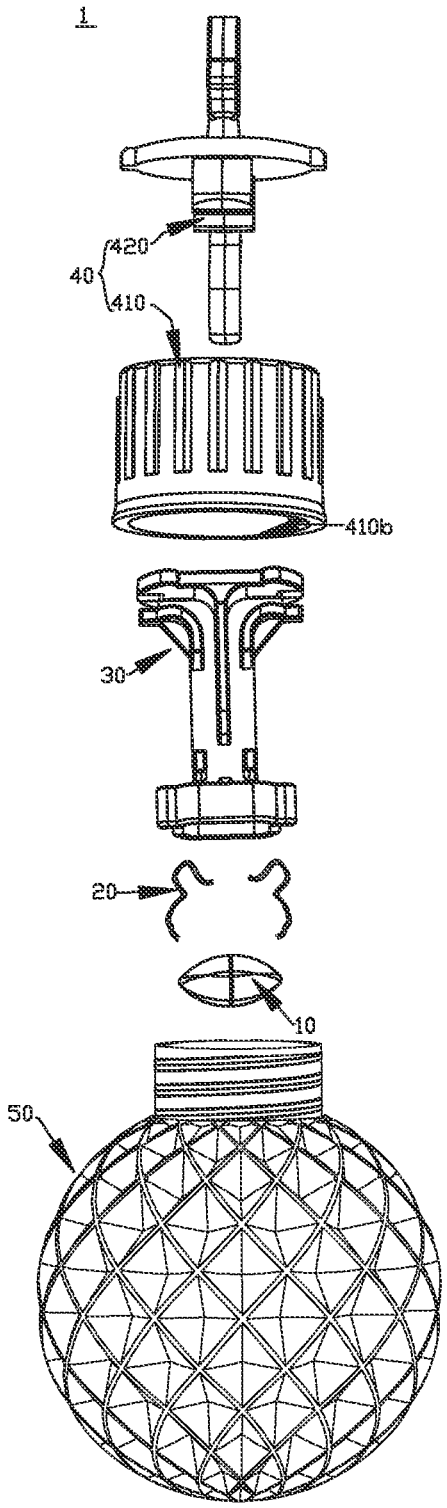
FIG. 8 is a schematic exploded view of FIG. 7.
Figure 12:
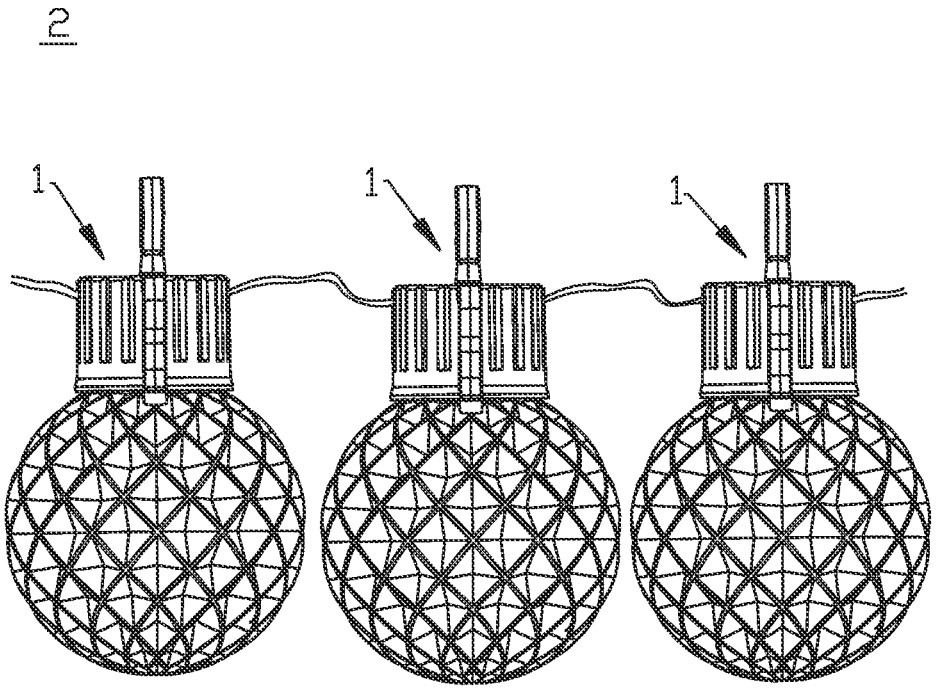
FIG. 12 is a schematic view of a light string according to some embodiments of the present disclosure.

As shown in FIG. 2, in some embodiments of the present disclosure, a wire arranging device 30 may be provided. As shown in FIG. 8, the wire arranging device 30 may be applied to a bulb lamp 1. It may be understandable that in practical applications, a plurality of bulb lamps 1 may be generally connected in series to form a light string 2, as shown in FIG. 12. As further shown in FIG. 1, the bulb lamp 1 may include a wick 10, and the wick 10 of the bulb lamp 1 may include wires 20 for connecting to other bulb lamps 1. For example, the wires 20 may have a lead-in wire 210 and a lead-out wire 220, and thus this bulb lamp 1 may be connected to other bulb lamps 1 via the lead-in wire 210 and the lead-out wire 220. However, in an existing bulb lamp, the lead-in wire and the lead-out wire are electrically connected to a plug to supply power to the bulb lamp, and the wick and the wires cannot be assembled with or disassembled from other components in the bulb lamp, which may bring a lot of troubles in use. For example, it is inconvenient to repair and replace the components of the bulb lamp in the light string (such as the wick, the wires, a lamp holder, a lampshade, or the like).

Based on the above reasons, in some embodiments of the present disclosure, the wire arranging device 30 of the bulb lamp 1 may be provided to install or mount or arrange the lead-in wire 210 and the lead-out wire 220 which are connected to the wick 10 of the bulb lamp 1, respectively. In some embodiments, the lead-in wire 210 and the lead-out wire 220 may be symmetrically arranged on two opposite sides of the wick 10. As shown in FIG. 1, the lead-in wire 210 and the lead-out wire 220 may be symmetrically arranged on, for example, the left side and the right side of the wick 10. Of course, those skilled in the art may arrange the lead-in wire 210 and the lead-out wire 220 on other positions of the wick 10 according to the actual needs, and the arranging positions of the lead-in wire 210 and the lead-out wire 220 may be not limited to the aforementioned exemplary two sides shown in FIG. 1.

Figure 3:
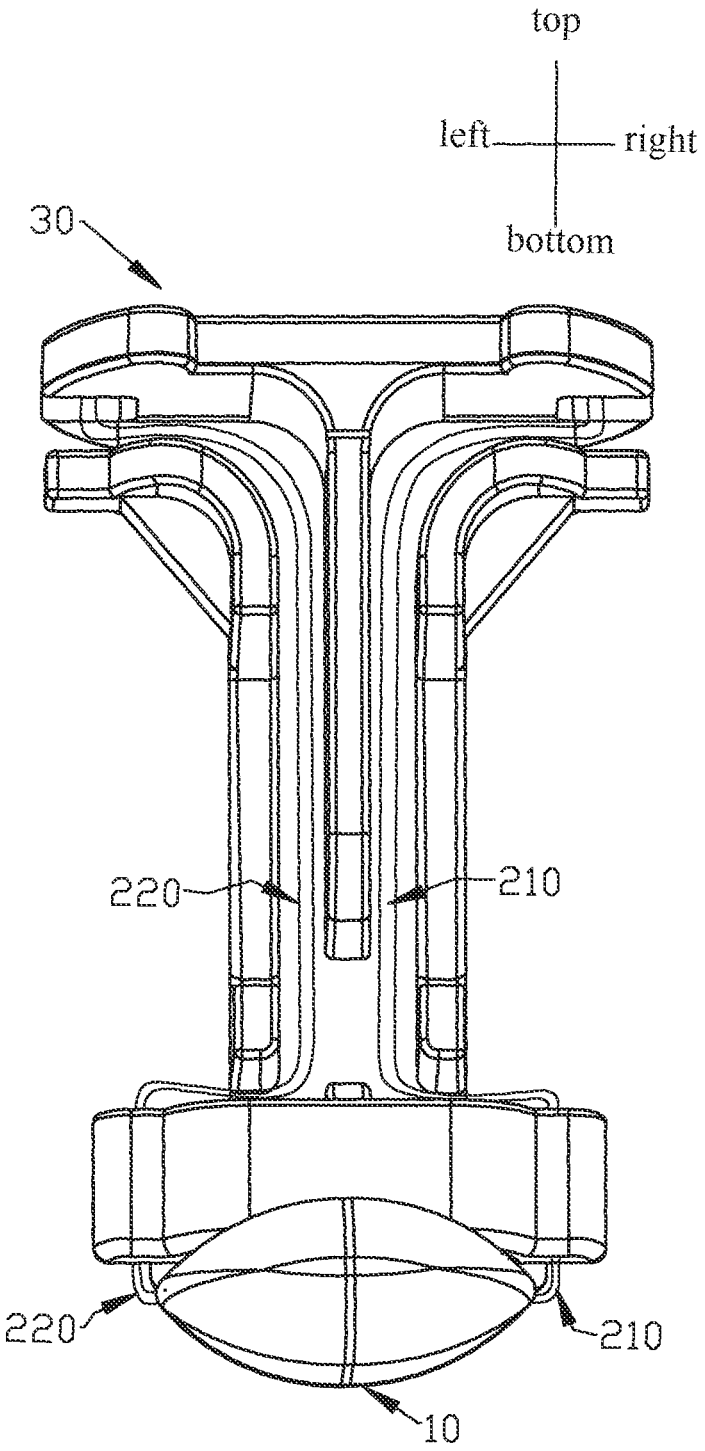
FIG. 3 is a schematic view illustrating that the wire arranging device of the bulb lamp is connected to the wick according to some embodiments of the present disclosure.

Based on the above, as shown in FIG. 3, the wire arranging device 30 may be configured to include a lead-in path 301 configured to arrange the lead-in wire 210, and further include a lead-out path 302 configured to arrange the lead-out wire 220. Furthermore, FIG. 3 shows a schematic view of the wick 10, the lead-in wire 210, and the lead-out wire 220 being mounted or arranged on the wire arranging device 30.

By using the lead-in path 301 and the lead-out path 302, the lead-in wire 210 and the lead-out wire 220 may be arranged in a reasonable and orderly manner in the wire arranging device 30, such that the lead-in wire 210 and the lead-out wire 220 may be detachably arranged in the bulb lamp 1, and convenient to be stored and maintained. In this way, the space occupied by the lead-in wire 210 and the lead-out wire 220 may be reduced, which makes the overall structure of the bulb lamp 1 more compact, and also enables the wires 20 to be arranged in the bulb lamp 1 in a more neat and beautiful way.

Furthermore, the wire arranging device 30 is configured as an independent component in the bulb lamp 1. In this way, it is possible to realize the detachable connection between the wick 10, the wires 20, and other components in the bulb lamp 1 (for example, a lamp holder 40, a lampshade 50, or the like).

Figure 4:
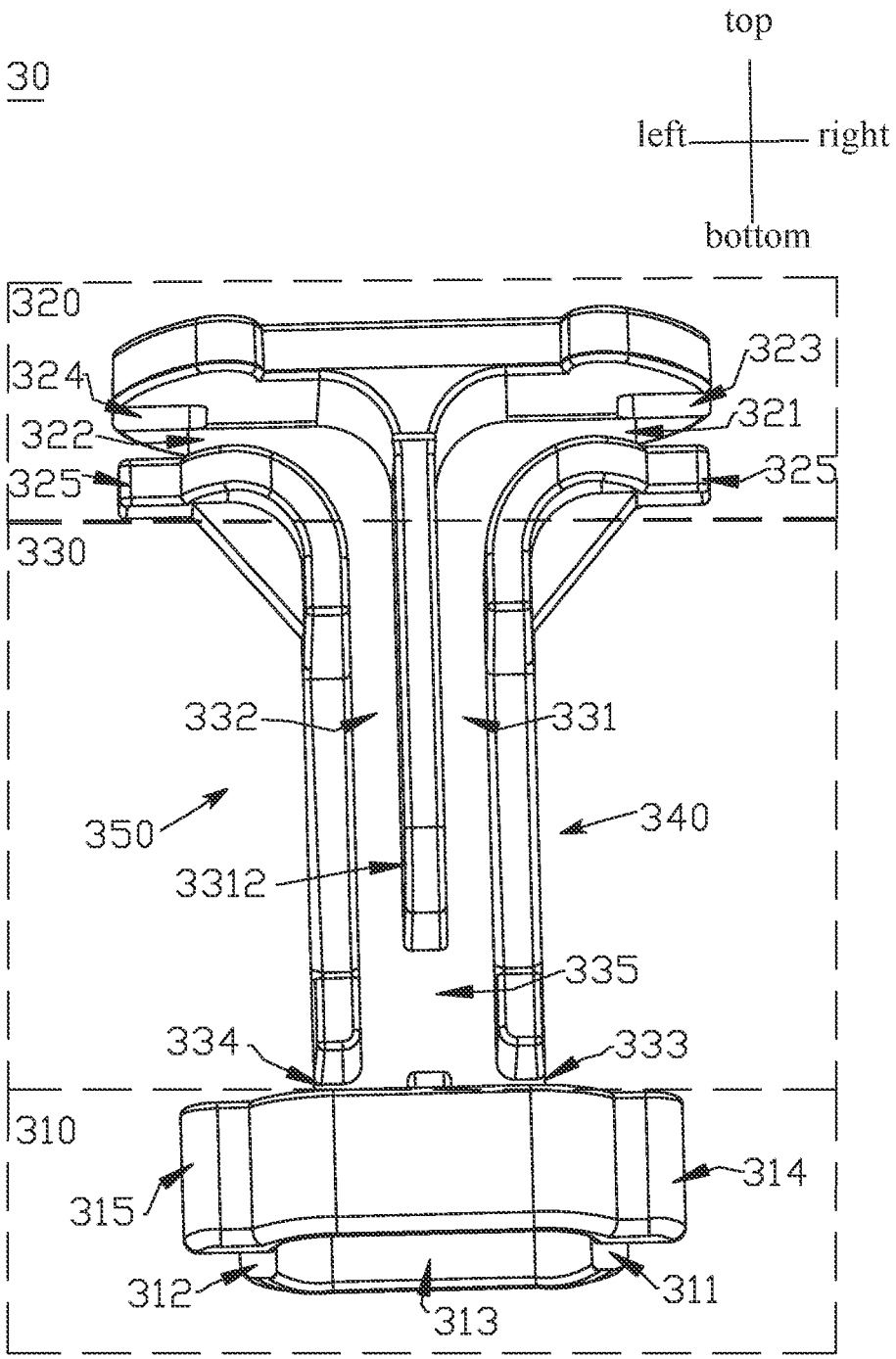
FIG. 4 is a schematic view of a wire arranging device of a bulb lamp according to some embodiments of the present disclosure.

Furthermore, as shown in FIG. 4, in some embodiments, the wire arranging device 30 may include a wick positioning portion 310, a holder connecting portion 320 connecting to the lamp holder 40 (as shown in FIG. 8), and a path extending portion 330 connected between the wick positioning portion 310 and the holder connecting portion 320. In some embodiments, the path extending portion 330 may extend from the wick positioning portion 310 to the holder connecting portion 320.

In some embodiments, the wire arranging device 30 may further include a lead-in restricting structure 340 for limiting or restricting or defining the lead-in path 301 and a lead-out restricting structure 350 for limiting or restricting or defining the lead-out path 302. Each of the lead-in restricting structure 340 and the lead-out restricting structure 350 may be arranged on and defined by each of the wick positioning portion 310, the holder connecting portion 320, and the path extending portion 330.

It should be noted that, the wick positioning portion 310 may be connected to the wick 10, the wick positioning portion 310 may be configured to fix a position of the wick 10 and reduce the possibility of shaking of the wick 10. The holder connecting portion 320 may be connected to the lamp holder 40. A length of the path extending portion 330 may be set as required. In some embodiments of the present disclosure, lengths of the lead-in path 301 and the lead-out path 302 and a distance between the wick 10 and the path extending portion 330 may be both adjusted based on the length of the path extending portion 330.

More specifically, as shown in FIG. 4, the lead-in restricting structure 340 and the lead-out restricting structure 350 may be implemented as grooves having the limiting or restricting function. However, in some other embodiments, the lead-in restricting structure 340 and the lead-out restricting structure 350 may also be implemented as other structures, such as restricting holes.

Figure 5:
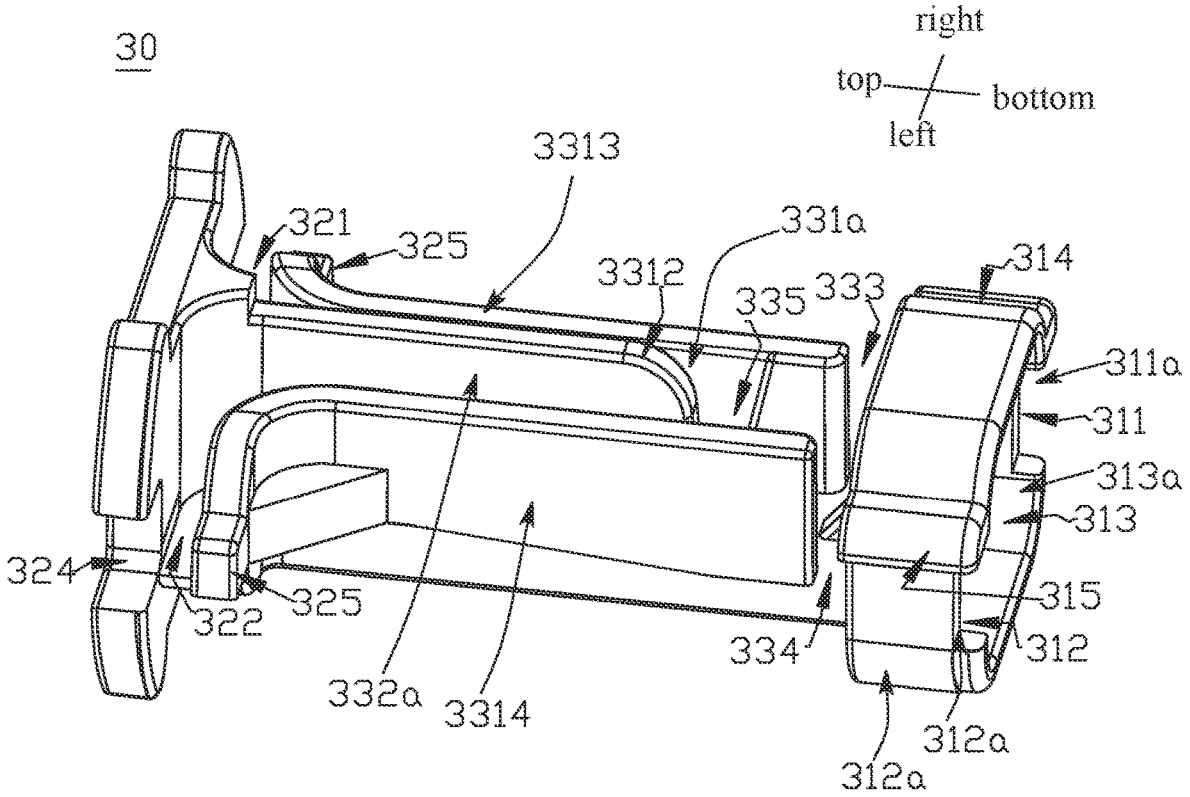
FIG. 5 is a schematic view of a wire arranging device of a bulb lamp according to some embodiments of the present disclosure.
Figure 6:
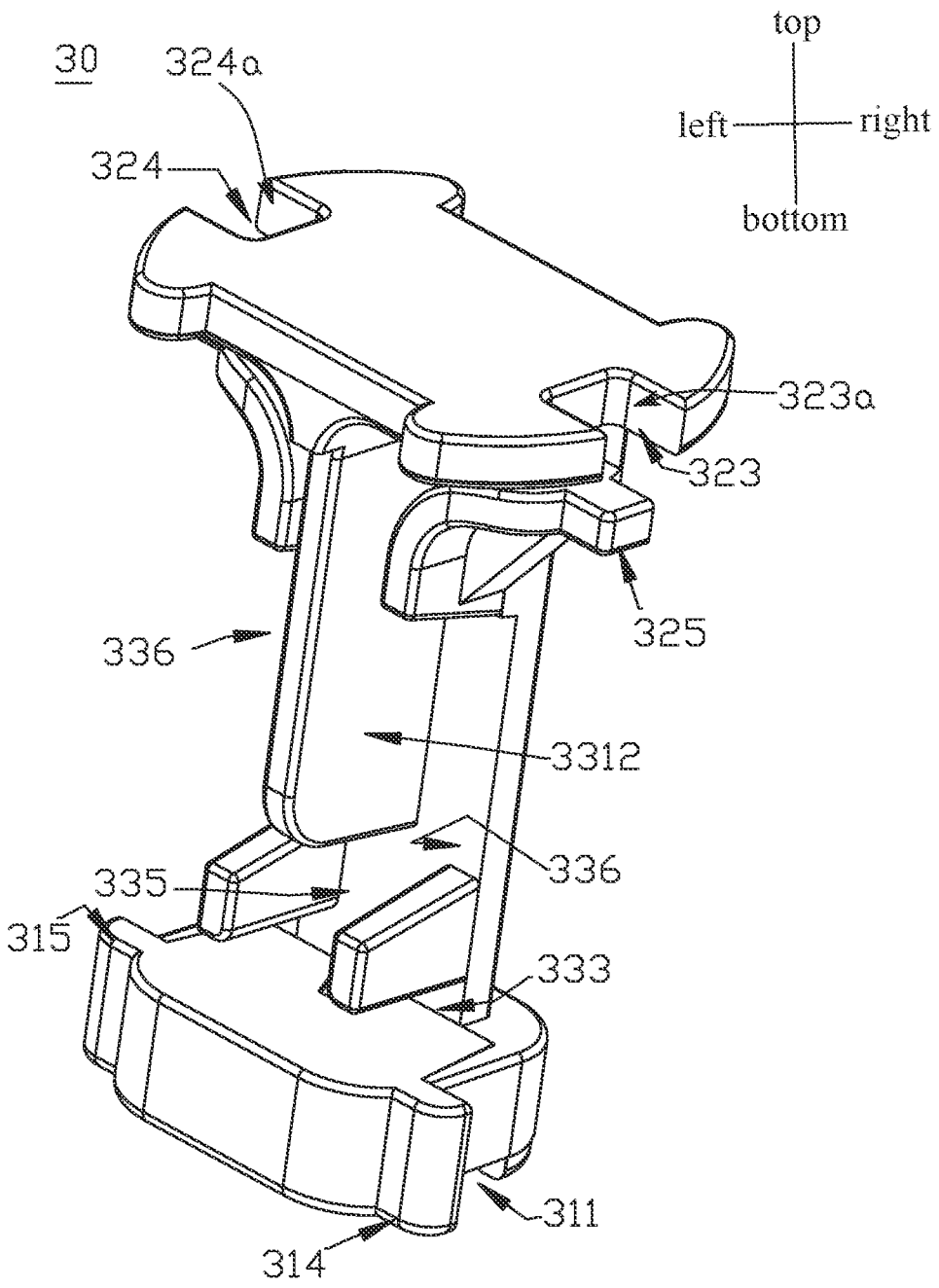
FIG. 6 is a schematic view of a wire arranging device of a bulb lamp according to some embodiments of the present disclosure.

In some embodiments, as shown in FIGS. 5-6, the lead-in restricting structure 340 and the lead-out restricting structure 350 may be implemented as grooves.

More specifically, the lead-in restricting structure 340 may include a first lead-in groove 311 defined in the wick positioning portion 310, and the lead-out restricting structure 350 may include a first lead-out groove 312 defined in the wick positioning portion 310.

The lead-in restricting structure 340 may further include a second lead-in groove 321 defined in the holder connecting portion 320, and the lead-out restricting structure 350 may further include a second lead-out Groove 322 defined in the holder connecting portion 320.

The lead-in restricting structure 340 may further include a third lead-in groove 331 defined in the path extending portion 330, and the lead-out restricting structure 350 may further include a third lead-out groove 332 defined in the path extending portion 330.

In some embodiments, as shown in FIG. 5, the second lead-in groove 321, the third lead-in groove 331, and the first lead-in groove 311 may be arranged subsequently from the top to the bottom. The lead-in path 301 may be formed or defined by the second lead-in groove 321, the third lead-in groove 331, and the first lead-in groove 311. As further shown in FIG. 5, the first lead-out groove 312, the third lead-out groove 332, and the second lead-out groove 322 may be arranged subsequently from the bottom to the top. The lead-out path 302 may be formed or defined by the first lead-out groove 312, the third lead-out groove 332, and the second lead-out groove 322.

It should be noted that, when installing the lead-in wire 210 and the lead-out wire 220, the lead-in wire 210 may be subsequently placed in and pass through the corresponding second lead-in groove 321, the third lead-in groove 331, and the first lead-in groove 311 along the lead-in path 301. The lead-out wire 220 may be subsequently placed in and pass through the corresponding the first lead-out groove 312, the third lead-out groove 332, and the second lead-out groove 322 along the lead-out path 302. That it to say, the lead-in wire 210 is led in the wire arranging device 30 from the second lead-in groove 321, while the lead-out wire 220 is led out of the wire arranging device 30 from the second lead-out groove 322.

In some embodiments, a width of the path extending portion 330 may be less than a width of the wick positioning portion 310, and further less than a width of the holder connecting portion 320. Herein, the width refers to a length along the left-right direction shown in the figures.

The path extending portion 330 may be located in a middle of the wick positioning portion 310 and a middle of the holder connecting portion 320 along a width direction. In this way, the wire arranging device 30 may be substantially in shape of an "I". It should be noted that, the width direction here refers to the left-right direction shown in the figures.

In some embodiments, the wick positioning portion 310 may define a receiving groove 313 on a back side away from the path extending portion 330. The receiving groove 313 may be configured to receive the wick 10. In other words, the receiving groove 313 may be defined at a bottom of the wick positioning portion 310, or the receiving groove 313 may be opened in a direction facing the bottom of the wick positioning portion 310. In this way, the wick 10 may be received in the receiving groove 313, such that the wick 10 may be better fixed or limited in the wick positioning portion 310.

Furthermore, the receiving groove 313 may be configured to receive or accommodate a part of a wick body of the wick 10. That is to say, only a part of the wick body of the wick 10 may be received in the receiving groove 313. In this way, it is possible to reduce the possibility of excessive shielding of the light emitted from the wick 10 by the receiving groove 313.

In some embodiments, the wick positioning portion 310 may include two opposite side walls 310*a* in the receiving groove 313. The first lead-in groove 311 and the first lead-out groove 312 may be arranged on the two opposite side walls in the receiving groove 313, respectively. As shown in FIG. 5, the two opposite side walls 310*a* may be the left side wall and the right side wall. Of course, in other embodiments, the two opposite side walls 310*a* may also be the front side wall and the rear side wall, which will not be limited in some embodiments of the present disclosure.

In some embodiments, the first lead-in groove 311 and the first lead-out groove 312 may be opened in a same opening direction as the receiving groove 313. More specifically, the first lead-in groove 311, the first lead-out groove 312, and the receiving groove 313 may be opened in the opening direction facing toward the bottom as shown in FIG. 5. Herein, the opening direction refers to the direction in which the opening faces towards, i.e., the opening is opened or recessed from the bottom towards the top in FIG. 5. Therefore, an opening 311*a* of the first lead-in groove 311 and an opening 312*a* of the first lead-out groove 312 may face towards the same direction as an opening 313*a* of the receiving groove 313.

In some embodiments, as shown in FIGS. 5-6, a lead-in restricting portion 314 may be arranged in the wick positioning portion 310 at a position near or adjacent to an opening 313*a* of the third lead-in groove 331. A lead-out restricting portion 315 may be arranged in the wick positioning portion 310 at a position near or adjacent to an opening 332*a* of the third lead-out groove 332. The lead-in restricting portion 314 and the lead-out restricting portion 315 may be configured to better limit or restrict the lead-in wire 210 in the lead-in path 301 and limit or restrict the lead-out wire 220 in the lead-out path 302.

In some embodiments, a wiring direction of the wire (that is, the lead-in wire) in the first lead-in groove 311 may be located in a plane different from a plane in which a wiring direction of the wire (that is, the lead-in wire) in the third lead-in groove 331 is located. A wiring direction of the wire (that is, the lead-out wire) in the first lead-out groove 312 may be located in a plane different from a plane in which a wiring direction of the wire (that is, the lead-out wire) in the third lead-out groove 332 is located. It should be noted that, the wiring directions in the first lead-in groove 311, the first lead-out groove 312, the third lead-in groove 331, and the third lead-out groove 332 are substantially the same or coincident with the corresponding lead-in path or lead-out path.

A wire inlet 333 may be defined between the third lead-in groove 331 and the wick positioning portion 310 along the wiring direction of the third lead-in groove 331, and a wire outlet 334 may be defined between the third lead-out groove 332 and the wick positioning portion 310 along the wiring direction of the third lead-out groove 332. That is to say, the wire inlet 333 may be defined between the third lead-in groove 331 and the wick positioning portion 310, and the wire outlet 334 may be defined between the third lead-out groove 332 and the wick positioning portion 310.

The wire inlet 333 may be configured to allow the lead-in wire 210 to extend out of the third lead-in groove 331 and further enter the first lead-in groove 311.

The wire outlet 334 may be configured to allow the lead-out wire 220 to extend out of the first lead-out groove 312 and further enter the third lead-out groove 332.

In some embodiments, the third lead-in groove 331 and the third lead-out groove 332 may be arranged adjacent to each other and further arranged side by side.

The path extending portion 330 may include a first restricting wall 3313, a second restricting wall 3314, and a partition wall 3312 disposed between the first restricting wall 3313 and the second restricting wall 3314. Herein, the first restricting wall 3313, the second restricting wall 3314, and the partition wall 3312 both extend along the wiring direction of the third lead-in groove 331 and the third lead-out groove 332. The partition wall 3312 may be connected to the holder connecting portion 320 and further disposed in the middle of the holder connecting portion 320 along the width direction. The partition wall 3312 and the first restricting wall 3313 may define the third lead-in groove 331, while the partition wall 3312 and the second restricting wall 3314 may define the third lead-out groove 332. That is, as shown in FIG. 5, the third lead-in groove 331 and the third lead-out groove 332 may share the partition wall 3312, and the partition wall 3312 may separate the third lead-in groove 331 from the third lead-out groove 332. The partition wall 3312 may define a first opening 335. More specifically, as shown in FIG. 5, a length of the partition wall 3312 may be less than a length of the first restricting wall 3313 and further less than a length of the second restricting wall 3314, such that the first opening 335 may be defined by the partition wall 3312, the first restricting wall 3313 and the second restricting wall 3314. Or, in other embodiments, a bottom of the partition wall 3312 may be spaced apart from the wick positioning portion 310, and thus the first opening 335 may be defined. The design of the first opening 335 may facilitate an operation of a finger of an operator to place the wire 20 into the corresponding third lead-in groove 331 and the third lead-out groove 332.

In some embodiments, each of the third lead-in groove 331 and the third lead-out groove 332 may define a second opening 336 on a corresponding outer side wall facing the path extending portion 330. That is to say, each of the first restricting wall 3313 and the second restricting wall 3314 defines one second opening 336. The design of the second opening 336 may facilitate the operation of the finger of the operator to place the wire 20 into the corresponding third lead-in groove 331 and the third lead-out groove 332.

In some embodiments, the third lead-in groove 331 may be fluidly connected to or coupled to the second lead-in groove 321. The third lead-out groove 332 may be fluidly connected to or coupled to the second lead-out groove 322. Thus, it is possible facilitate the wiring.

In some embodiments, the lead-in restricting structure 340 may further include a fourth lead-in groove 323 defined in the holder connecting portion 320. The lead-out limiting structure 350 may further include a fourth lead-out groove 324 defined in the holder connecting portion 320.

An opening 323*a* of the fourth lead-in groove 323 may be opened in a direction opposite to the direction of the opening 313*a* of the receiving groove 313. An opening 324*a* of the fourth lead-out groove 324 may be opened in a direction opposite to the direction of the opening 313*a* of the receiving groove 313.

In some embodiments, as shown in FIG. 6, the fourth lead-in groove 323, the second lead-in groove 321, the third lead-in groove 331, and the first groove 311 may be arranged subsequently from the top to the bottom. The lead-in path 301 may be formed or defined by the fourth lead-in groove 323, the second lead-in groove 321, the third lead-in groove 331, and the first lead-in groove 311. As further shown in FIG. 6, the first lead-out groove 312, the third lead-out groove 332, the second lead-out groove 322, and the fourth lead-out groove 324 may be arranged subsequently from the bottom to the top. The lead-out path 302 may be formed or defined by the first lead-out groove 312, the third lead-out groove 332, the second lead-out groove 322, and the fourth lead-out groove 324.

Since the opening 313*a* of the receiving groove 313 faces the bottom of the holder connecting portion 320, the opening 323*a* of the fourth lead-in groove 323 and the opening 324*a* of the fourth lead-out groove 324 may face a top of the holder connecting portion 320, In this way, the lead-in wire 210 may enter from the top of the holder connecting portion 320 through the fourth lead-in groove 323, and the lead-out wire 220 may be led out or discharged from the top of the holder connecting portion 320 through the fourth lead-out groove 324. Generally speaking, the lamp holder 40 and the wick 10 are respectively arranged at opposite sides of the wire arranging device 30, and the lead-in wire 210 and the lead-out wire 220 need to pass through the lamp holder 40 at least partially coveting the top of the holder connecting portion 320. Thus, the above design may facilitate the arrangement of the lead-in wire 210 and the lead-out wire 220.

In some embodiments, the fourth lead-in groove 323 may be fluidly coupled to the second lead-in groove 321. The fourth lead-out groove 324 may be fluidly coupled to the second lead-out groove 322.

In some embodiments, the lead-in path 301 may be symmetrical to the lead-out path 302, which facilitates the design of the lead-in path 301 and the lead-out path 302. More specifically, as shown in FIGS. 5-6, the lead-in path 301 and the lead-out path 302 may be symmetrically arranged about the partition wall 3312.

Bulb Lamp

Figure 7:
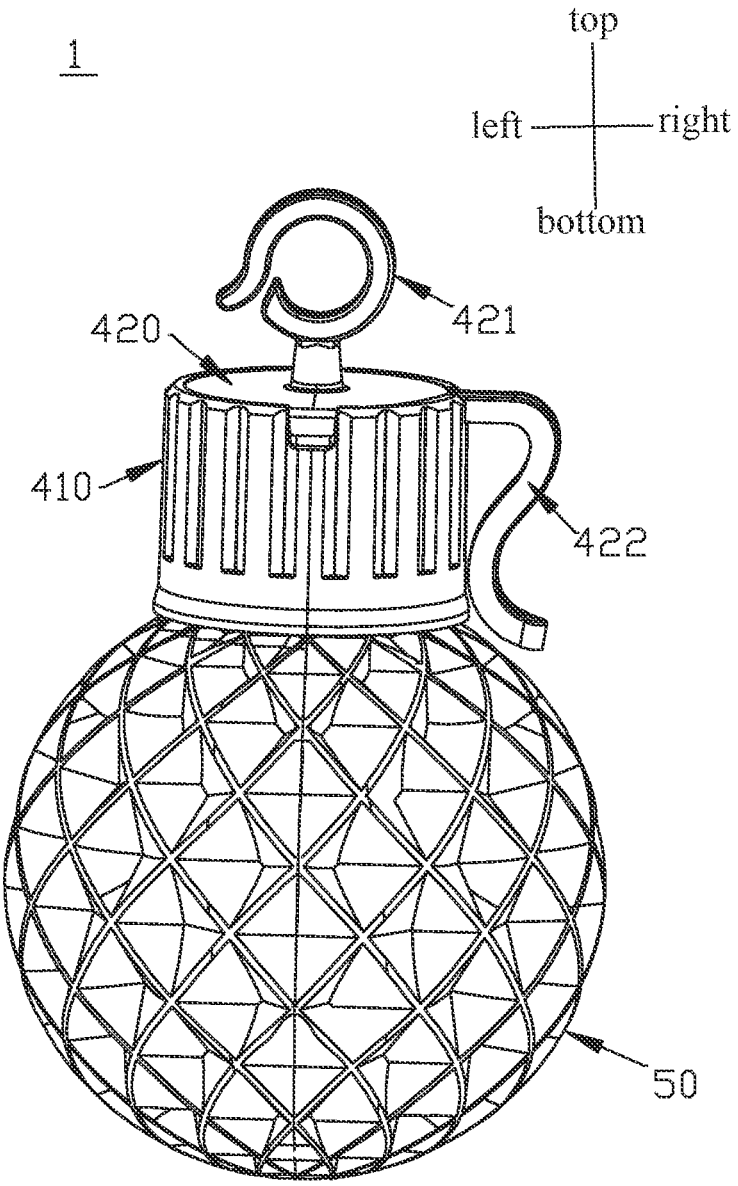
FIG. 7 is a schematic view of the bulb lamp according to some embodiments of the present disclosure.
Figure 9:
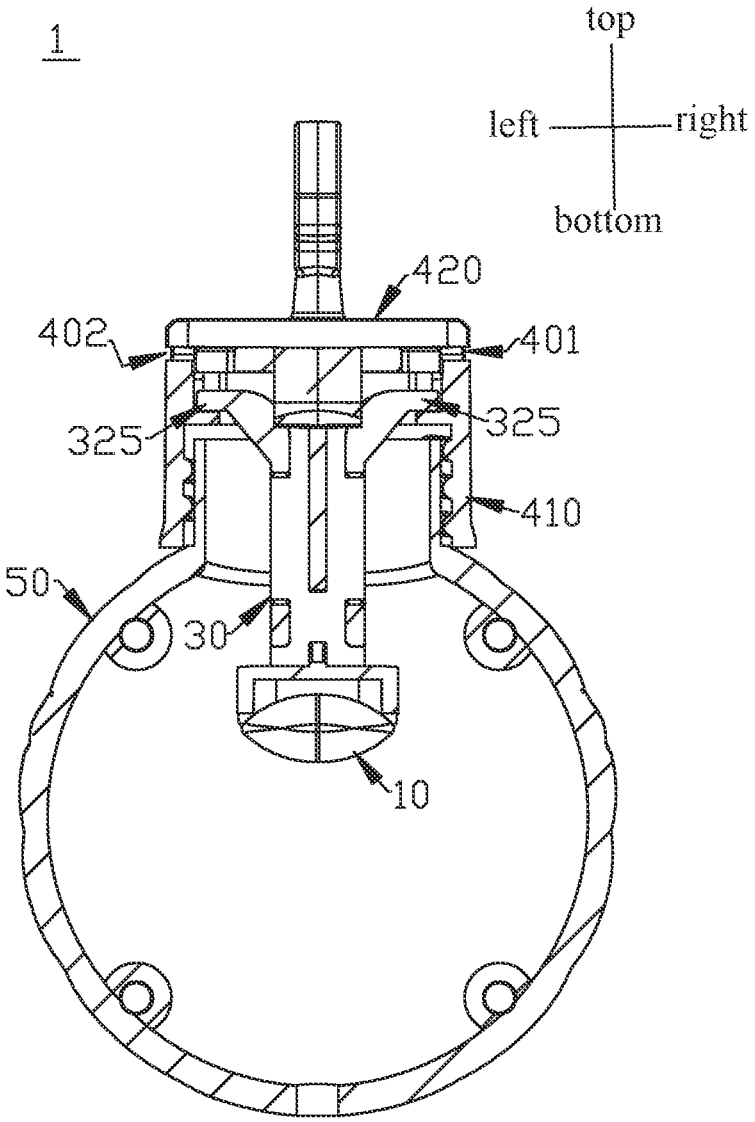
FIG. 9 is a schematic cross-sectional view of FIG. 7.

Based on the foregoing wire routing device 30 for the bulb lamp, and further referring to FIGS. 7-9 (herein, FIG. 8 is an exploded view of FIG. 7, and FIG. 9 is a cross-sectional view of FIG. 7), a bulb lamp 1 may also be disclosed in some embodiments of the present disclosure. The bulb lamp 1 may include a wire arranging device 30, a wick 10, a lead-in wire 210, a lead-out wire 220, and a lamp holder 40.

The wire arranging device 30 may be those described in the foregoing embodiments.

The wick 10 may be disposed at the bottom of the wire arranging device 30.

The lead-in wire 210 and the lead-out wire 220 may be connected to the wick 10.

The lamp holder 40 may be arranged at the top of the wire arranging device 30, That is to say, the wick 10 and the lamp holder 40 may be disposed at two opposite sides of the wire arranging device 30. In some embodiments, the lamp holder 40 may define a receiving space. The wire arranging device 30 may be at least partially received in the receiving space and may be detachably connected to the lamp holder 40.

In some embodiments of the present disclosure, the wire arranging device 30 may be detachably connected to the lamp holder 40 via a screw connection or an engaging connection. The detachable connection mode may be determined by those skilled in the art according to actual needs of installation, and may be not limited to the above-mentioned exemplary screw connection or engaging connection.

Figure 10:
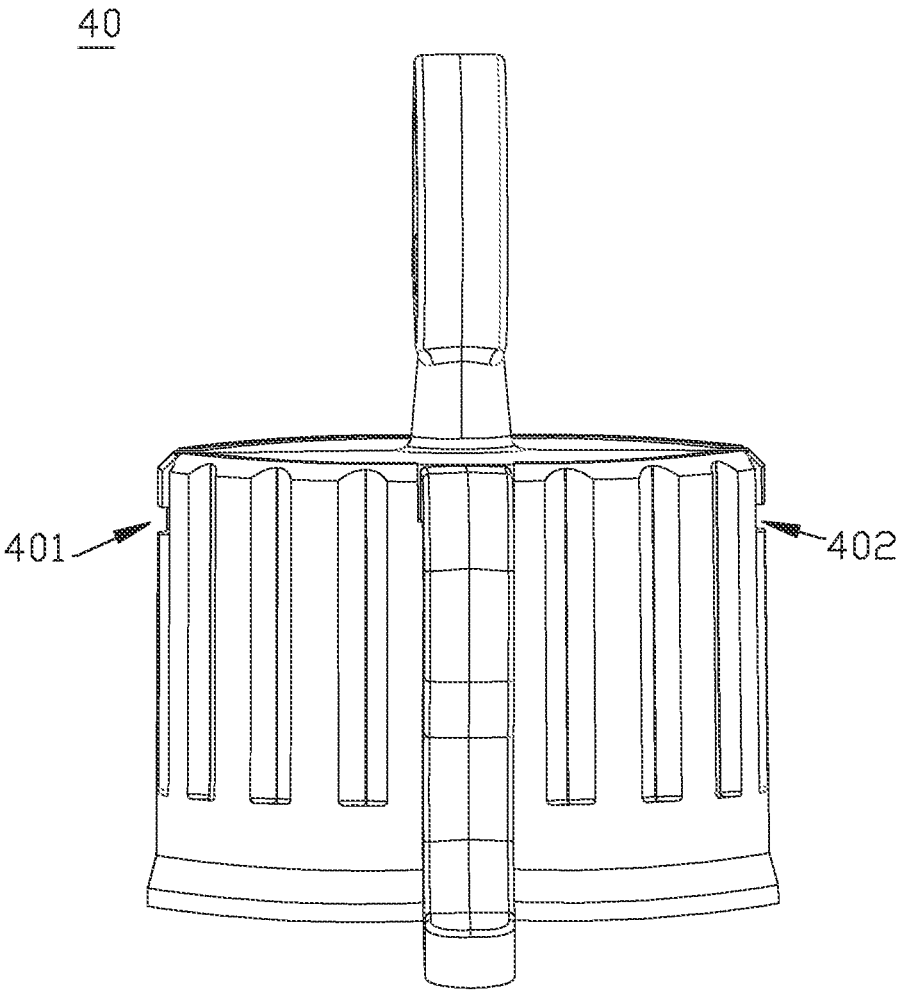
FIG. 10 is a schematic view of a lamp holder according to some embodiments of the present disclosure.

As further shown in FIGS. 9 and 10, in some embodiments, the lamp holder 40 may define a wire inlet hole 401 and a wire outlet hole 402.

The wire inlet hole 401 may correspond to the lead-in path 301.

The wire outlet hole 402 may correspond to the lead-out path 302.

In some embodiments, the wire inlet hole 401 and the wire outlet hole 402 may be arranged symmetrically, which facilitates the leading in and out of the wires.

In some embodiments, as shown in FIGS. 8-9, the lamp holder 40 may include a holder body 410 and a connecting member 420.

The holder body 410 may be hollow and may have an opening 410*a* at a top end and an opening 410*b* at a bottom end. That is to say, the opening 410*a* is defined at an end away from the wire arranging device 30, while the opening 410*b* is defined at an end adjacent to the wire arranging device 30.

The connecting member 420 may be detachably connected to the holder body 410 at the opening 410*a* at the top end of the holder body 410. More specifically, as shown in FIGS. 8-9, the connecting member 420 may be inserted into the opening 410*a*, and be further detachably connected to the holder body 410.

As shown in FIG. 7, a first hook 421 and a second hook 422 may be arranged on the connecting member 420.

It should be noted that, the first hook 421 may be arranged above the connecting member 420, that is, the first hook 421 may be arranged at the top end of the connecting member 420. The second hook 422 may be arranged at any position on an outer side of the connecting member 420.

Figure 11:
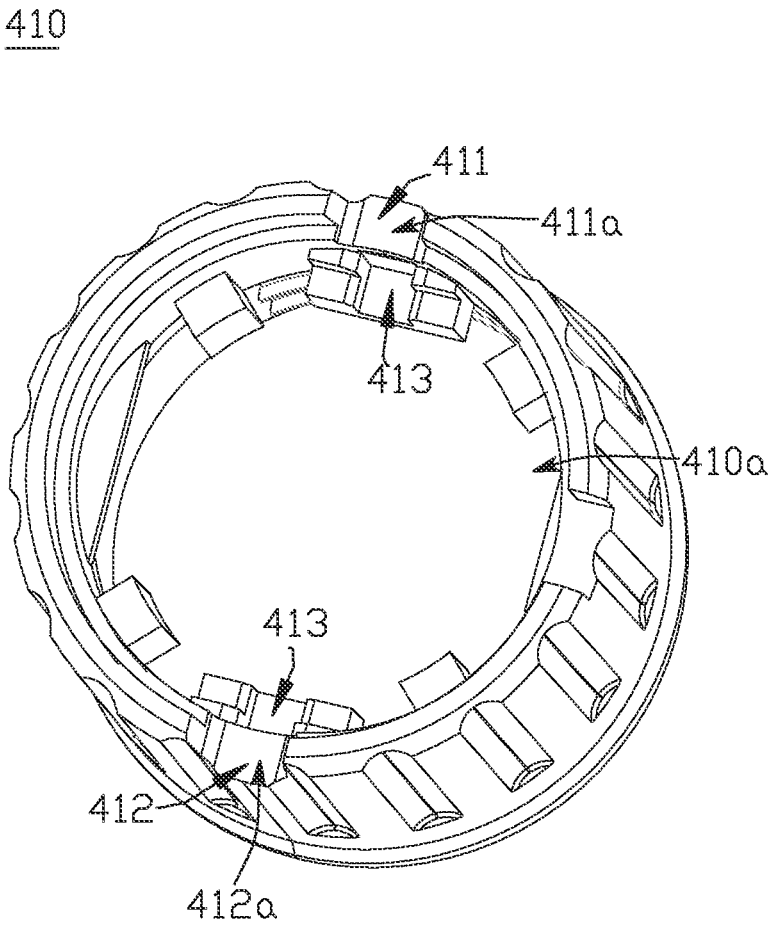
FIG. 11 is a schematic view of a holder body according to some embodiments of the present disclosure

As shown in FIG. 11, in some embodiments, an outlet recess 411 and an inlet recess 412 may be defined on a side wall at the top end of the holder body 410, After the connecting member 420 is connected to the holder body 410, an opening end 411*a* of the outlet recess 411 may be covered by the connecting member 420 to define or form the wire outlet hole 402. An opening end 412*a* of the inlet recess 412 may be covered by the connecting member 420, and thus the wire inlet hole 401 may be formed or defined correspondingly in this case.

In some embodiments, as shown in FIG. 11, an engaging groove 413 may be defined on an inner side wall of the holder body 410. As further shown in FIG. 9, an engaging portion 325 corresponding to the engaging groove 413 may be arranged on the holder connecting portion 320. The holder body 410 may be detachably connected to the holder connecting portion 320 via the engaging groove 413 and the engaging portion 325, such that the wire arranging device 30 may be detachably connected to the lamp holder 40. When the holder body 410 is connected to the holder connecting portion 320, the engaging portion 325 may be engaged with the engaging groove 413.

In some embodiments, as shown in FIGS. 7-8, the bulb lamp 1 may further include a lampshade 50.

The lampshade 50 may be detachably connected to the lamp holder 40.

When the lamp holder 40 is connected to the lampshade 50, the wick 10 may extend into the lampshade 50.

Light String

Based on the aforementioned bulb lamp 1 and the wire arranging device 30, as shown in MG. 12, in some embodiments of the present disclosure, a light string 2 may be further disclosed. The light string 2 may include a plurality of wire arranging devices 30 or bulb lamps 1 as described in the foregoing embodiments.

Although some embodiments of the present disclosure have been disclosed as above, however, the embodiments of the present disclosure are not limited to usage listed in the specification and examples above. The embodiments may be applied to various fields suitable for the present disclosure. For those skilled in the art, additional modifications may be easily implemented. Thus, the present disclosure is not limited to the specific details and the illustrations shown and described here without departing from the general concept defined by the claims and equivalent scope.

What is claimed is:

1. A wire arranging device for a bulb lamp, configured to arrange a lead-in wire and a lead-out wire, the wire arranging device comprising:

a lead-in path, configured to arrange the lead-in wire;

a lead-out path, configured to arrange the lead-out wire, a wick positioning portion;

a holder connecting portion, configured to directly connect to a lamp holder of the bulb lamp;

a path extending portion, directly connected between the wick positioning portion and the holder connecting portion;

a lead-in restricting structure, configured to restrict the lead-in path;

a lead-out restricting structure, configured to restrict the lead-out path; wherein each of the lead-in restricting structure and the lead-out restricting structure is arranged on the wick positioning portion, the holder connecting portion, and the path extending portion;

wherein the lead-in restricting structure comprises:

a first lead-in groove, defined in the wick positioning portion;

a second lead-in groove, defined in the holder connecting portion; and a third lead-in groove, defined in the path extending portion;

wherein the second lead-in groove, the third lead-in groove, and the first lead-in groove are subsequently arranged, and the lead-in path is defined by the second lead-in groove, the third lead-in groove, and the first lead-in groove;

wherein the lead-out restricting structure comprises:

a first lead-out groove, defined in the wick positioning portion;

a second lead-out groove, defined in the holder connecting portion; and a third lead-out groove, defined in the path extending portion;

wherein the first lead-out groove, the third lead-out groove, and the second lead-out groove are subsequently arranged, and the lead-out path is defined by the first lead-out groove, the third lead-out groove, and the second lead-out groove; and wherein a wiring direction of the first lead-in groove is located in a plane different from a plane in which a wiring direction of the third lead-in groove is located; and a wiring direction of the first lead-out groove is located in a plane different from a plane in which a wiring direction of the third lead-out groove is located;

a wire inlet is defined between the third lead-in groove and the wick positioning portion along the wiring direction of the third lead-in groove, and the wire inlet is configured to enable the lead-in wire to extend out of the third lead-in groove and further enter the first lead-in groove; and a wire outlet is defined between the third lead-out groove and the wick positioning portion along the wiring direction of the third lead-out groove, and the wire outlet is configured to enable the lead-out wire to extend out of the first lead-out groove and further enter the third lead-out groove.

2. The wire arranging device as claimed in claim 1, wherein the path extending portion is located in a middle of the wick positioning portion and a middle of the holder connecting portion along a width direction.

3. The wire arranging device as claimed in claim 1, wherein the wick positioning portion defines a receiving groove on a side away from the path extending portion, and the receiving groove is configured to receive a wick of the bulb lamp.

4. The wire arranging device as claimed in claim 3, wherein the lead-in restricting structure comprises: a first lead-in groove, defined in the wick positioning portion; a second lead-in groove, defined in the holder connecting portion; and a third lead-in groove, defined in the path extending portion; wherein the second lead-in groove, the third lead-in groove, and the first lead-in groove are subsequently arranged, and the lead-in path is defined by the second lead-in groove, the third lead-in groove, and the first lead-in groove; wherein the lead-out restricting structure comprises: a first lead-out groove, defined in the wick positioning portion; a second lead-out groove, defined in the holder connecting portion; and a third lead-out groove, defined in the path extending portion; wherein the first lead-out groove, the third lead-out groove, and the second lead-out groove are subsequently arranged, and the lead-out path is defined by the first lead-out groove, the third lead-out groove, and the second lead-out groove; and wherein the wick positioning portion comprises two opposite side walls in the receiving groove, and the first lead-in groove and the first lead-out groove are arranged on the two opposite side walls in the receiving groove.

5. The wire arranging device as claimed in claim 4, wherein an opening of the first lead-in groove and an opening of the first lead-out groove faces towards a same direction as an opening of the receiving groove.

6. The wire arranging device as claimed in claim 1, wherein a lead-in restricting portion is arranged in the wick positioning portion at a position adjacent to an opening of the third lead-in groove; and a lead-out restricting portion is arranged in the wick positioning portion at a position adjacent to an opening of the third lead-out groove.

7. The wire arranging device as claimed in claim 1, wherein the third lead-in groove and the third lead-out groove are arranged side by side; the path extending portion comprises a partition wall separating the third lead-in groove from the third lead-out groove, and the partition wall defines a first opening.

8. The wire arranging device as claimed in claim 1, wherein the path extending portion comprises a first restricting wall, a second restricting wall, and partition wall disposed between the first restricting wall and the second restricting wall, and each of the first restricting wall and the second restricting wall defines a second opening.

9. The wire arranging device as claimed in claim 4, wherein the lead-in restricting structure further comprises a fourth lead-in groove defined in the holder connecting portion; the lead-out limiting structure further comprises a fourth lead-out groove defined in the holder connecting portion; an opening of the fourth lead-in groove faces towards a direction opposite to a direction which an opening of the receiving groove faces towards; and an opening of the fourth lead-out groove faces towards a direction opposite to a direction which the opening of the receiving groove faces towards.

10. The wire arranging device as claimed in claim 1, wherein the lead-in path is symmetrical to the lead-out path.

11. A bulb lamp, comprising: a lead-in wire and a lead-out wire; a wire arranging device, configured to arrange the lead-in wire and the lead-out wire, the wire arranging device comprising: a lead-in path, configured to arrange the lead-in wire; a lead-out path, configured to arrange the lead-out wire; a wick positioning portion; a holder connecting portion, configured to directly connect to a lamp holder of the bulb lamp; a path extending portion, directly connected between the wick positioning portion and the holder connecting portion; a lead-in restricting structure, configured to restrict the lead-in path; and a lead-out restricting structure, configured to restrict the lead-out path; wherein each of the lead-in restricting structure and the lead-out restricting structure is arranged on the wick positioning portion, the holder connecting portion, and the path extending portion; a wick, wherein the lead-in wire and the lead-out wire are connected to the wick; and a lamp holder, wherein the wick and the lamp holder are arranged at two opposite sides of the wire arranging device; wherein the wire arranging device is at least partially received in the lamp holder and detachably connected to the lamp holder;

wherein the lamp holder defines:

a wire inlet hole, corresponding to the lead-in path; and a wire outlet hole, corresponding to the lead-out path, wherein the lamp holder further comprises:

a holder body, being hollow and having an opening defined at an end of the holder body away from the wire arranging device and an opening defined at an end of the holder body adjacent to the wire arranging device; and a connecting member, detachably connected to the holder body at the opening defined at the end of the holder body away from the wire arranging device;

wherein a first hook and a second hook are arranged on the connecting member wherein an outlet recess and an inlet recess are defined on a side wall at the end of the holder body away from the wire arranging device;

when the connecting member is connected to the holder body, an opening end of the outlet recess is covered by the connecting member to define the wire outlet hole, and an opening end of the inlet recess is covered by the connecting member to define the wire inlet hole.

12. The bulb lamp as claimed in claim 11, wherein an engaging groove is defined on an inner side wall of the holder body, and an engaging portion corresponding to the engaging groove is arranged on the holder connecting portion; and the holder body is detachably connected to the holder connecting portion via the engaging groove and the engaging portion, such that the wire arranging device is detachably connected to the lamp holder.

* * * * *